United States Patent [19]

Lin

[11] Patent Number: 4,790,020

[45] Date of Patent: Dec. 6, 1988

[54] HORN TYPE LOUDSPEAKERS

[76] Inventor: Kuang-Yao Lin, No. 5 Lane 110, Wei-Kuao Street, Tainan, Taiwan

[21] Appl. No.: 112,110

[22] Filed: Oct. 26, 1987

[51] Int. Cl.[4] ..... G10K 13/00

[52] U.S. Cl. ..... 381/156; 181/185

[58] Field of Search ..... 181/185, 187, 188, 189, 181/191, 192, 195; 381/156, 158, 160, 192, 193, 194, 202

[56] References Cited

U.S. PATENT DOCUMENTS

| | | | |
|---|---|---|---|
| 2,692,913 | 10/1954 | Kamimori | 181/188 X |
| 3,112,374 | 11/1963 | Görike | 381/202 X |
| 3,329,777 | 7/1967 | Kliewer | 381/194 X |
| 4,378,471 | 3/1983 | Shintaku | 381/156 |

*Primary Examiner*—L. T. Hix

*Assistant Examiner*—Brian W. Brown

*Attorney, Agent, or Firm*—Bacon & Thomas

[57] ABSTRACT

A horn type loudspeaker comprises a drive unit, which is largely the same in structure and features as the conventional drive unit, and a horn member specially designed to effectively minimize its size and weight. Said horn member comprises a hollow disk mounting case with its inner periphery corresponding to a fixing plate of the drive unit engaged thereon, a reflection cover with a tip on its inner surface pointing downwardly towards the central portion of a hole located at the fixing plate connected to the upper inner surface of said mounting case with a plurality of discharge openings uniformly located around the outer periphery so as to overcome the restriction of the standard sizes and have a size and weight small and light enough for miniature applications such as for pocket-size security alarms.

4 Claims, 3 Drawing Sheets

HORN TYPE LOUDSPEAKERS

BACKGROUND OF THE INVENTION

1. Field of the Invention

This invention relates to the design and construction of a loudspeaker, particularly to the design and construction of a horn type loudspeaker.

2. Prior Art

The structure of a conventional horn type loudspeaker, as shown in FIG. 1, usually consists of a drive unit 1 and a horn member 2. The drive unit 1 includes: an outer shell 10; a yoke 11 with a center pole 110 vertically protruding from its center portion; a hollow permanent magnet 12 and a guide ring 13 made of a kind of material with magnetic conductivity, said magnet 12 and guide ring 13 stacking sequentially around said center pole 110 to form gaps 120, 130 therebetween; a damper 14 formed with a dome-shaped diaphragm 15 at its central hollow portion and affixed to the guide ring 13 around its edge by a fixing plate 16 on top and a gasket 141 underneath made of an insulating material; and a voice coil 17 attached to the bottom outer surface of the diaphragm 15 extending downward into gap 130, and connected electrically to a D.C. electrical power source(not shown). The fixing plate 16 has a hole 160 at its center portion corresponding to the position of the diaphragm 15, and an air chamber 18 is formed between the fixing plate 16 and the diaphragm 15 with its adjoining damper 14.

The horn members 2 usually comprise: a horn 21 with its lower end combining with the outer shell 10 of the drive unit 1; a throttle 23 force-fitted vertically into the hole 160 of said fixing plate 16; and a reflection cover 22 between the horn 21 and the throttle 23 with a tip 221 on its inner bottom surface pointing inwardly towards the central portion of the said throttle 23.

The poles of the center pole 110 and the guide ring 13 are located such that the flux will radiate from the center pole 110 towards the guide ring 13. The voice coil 17 will be energized by the input of voice through a microphone, and the appropriate electrical power source. The directions of the current in the voice coil 17 and said flux are crossed with each other thereby actuating the diaphragm 15 to move back and forth axially, driving the air in the air chamber 18 to form corresponding sound waves. Said sound waves will radiate through the throttle 23, are reflected by the reflection cover 22, travel upward through the horn 21 and are eventually discharged from the open end.

It is to be understood that the dimensions of the horn 21 of the conventional horn type loudspeaker is supposed to follow the standard scale shown in FIG. 2. According to this standard, the minimum size and weight of a 100 decibel (dB) horn type loudspeaker are 90 mm (diameter)×95 mm (height) and 440 grams respectively. It is quite impossible for the conventional horn type loudspeaker to have a size and weight small and light enough for miniature applications such as for pocket-size security alarms.

SUMMARY OF THE INVENTION

It is therefore a primary object of this invention to provide a horn type loudspeaker that overcomes the foregoing disadvantages associated with the prior art.

The horn type loudspeaker of the present invention is a combination of a drive unit and a horn member. The drive unit is largely the same in structure and features as the conventional drive unit shown in FIG. 1. But to overcome the restriction of the standard sizes of FIG. 2, the horn member is specially designed to effectively minimize its size and weight. The horn member comprises: a hollow disk mounting case with its inner periphery corresponding to the fixing plate of the drive unit engaged thereon; a reflection cover with a tip on its inner surface pointing inwardly towards the central portion of a hole in said fixing plate and is connected to the upper inner surface of said case with a plurality of discharge openings uniformly located around the outer periphery.

The above-mentioned horn member may further comprise a disk member between the reflection cover and the fixing plate, said disk member having a throttle extending downwards in its central portion, and the contours of its inner surface staggered with respect to the contours of the opposing surface of the reflection cover.

Alternatively, the reflection cover and the mounting case can be formed integrally and properly enlarged to engage the corresponding pheriphery of an enlarged yoke having a plurality of discharge openings uniformly located around its periphery.

Other advantages and characteristics of this invention will become clear from the following description of a preferred embodiment when read in conjunction with the accompanying drawings.

DETAILED DESCRIPTION OF THE PREFERRED EMBODIMENTS

Figure 1:
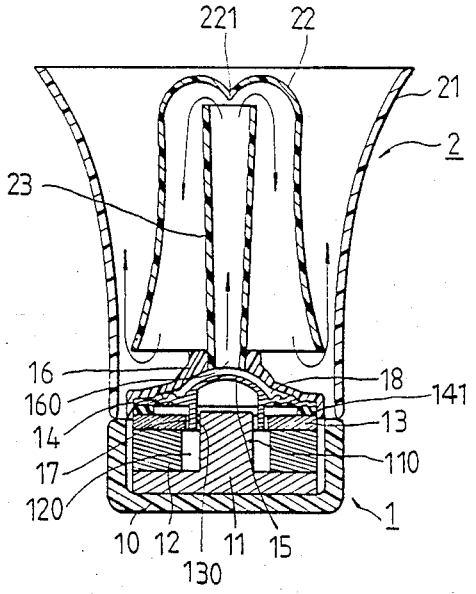
FIG. 1 PRIOR ART
FIG. 1 is a cross-sectional view of a conventional horn type loudspeaker.
Figure 3:
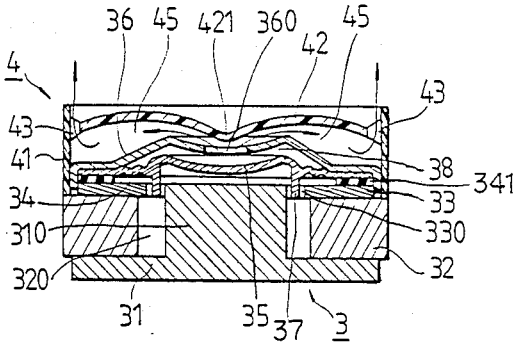
FIG. 3 is a cross-sectional view of a horn type loudspeaker embodying the present invention.

Referring to FIG. 3, the preferred embodiment of a horn type loudspeaker according to the present invention is a combination of a drive unit 3 and a horn member 4, with the structure and features of the drive unit 3 substantially the same as the conventional drive unit 1 as shown in FIG. 1. The drive unit 3 includes: a yoke 31 with a center pole 310 vertically protruding from its center portion; a hollow material 32 with magnetic conductivity, said magnet 32 and guide ring 33 stacking sequentially around said center pole 310 to form gaps 320, 330 therebetween; a damper 34 formed with a dome-shaped diaphragm 35 at its central hollow portion and affixed to the guide ring 33 around its edge by a fixing plate 36 on top and a gasket 341 underneath made of an insulating material; and a voice coil 37 attached to the outer bottom surface of the diaphragm 35 extending downwards into gap 330 and connected electrically to a D.C. electrical power source (not shown). The fixing plate 36 has a hole 360 at its center portion corresponding to the position of diaphragm 35, forming an air chamber 38 between the fixing plate 36 and the diaphragm 35 and the damper 34.

Said horn member 4 comprises: a hollow disk mounting case 41 with its inner periphery corresponding to the fixing plate 36 of the drive unit 3 and engaged thereon; a reflection cover 42 with a tip 421 on its inner surface pointing inwardly towards the central portion of the hole 360 is connected to the upper inner surface of said mounting case 41 and defines a plurality of discharge openings 43 uniformly located around the outer pheriphery.

As the structure and features of the drive unit 3 of this embodiment are mostly the same as the conventional design, sound waves are similarly formed by vibrating air in the air chamber 38 driven by the diaphragm 35. The sound waves radiate through the hole 360, are reflected by the reflection cover 42, distribute radially along the diffuse passages 45 and are eventually discharged through the openings 43.

According to the present invention, and illustrated in FIG. 3, said horn member 4 may further comprise a disk member 44 between the reflection cover 42 and the fixing plate 36, said disk member 44 having a throttle 441 extending downwards in its center portion, and the contours 440 of its inner surfaces staggered with respect to the contours 420 of the opposing surface of the reflection cover 42. The sound waves formed by the vibrating air in the air chamber 38 driven by the diaphragm 35 radiate through the hole 360 and the throttle 441, are reflected by the reflection cover 42, distribute radially along the diffuse passages 45 and are eventually discharged through the openings 43.

Figure 2:
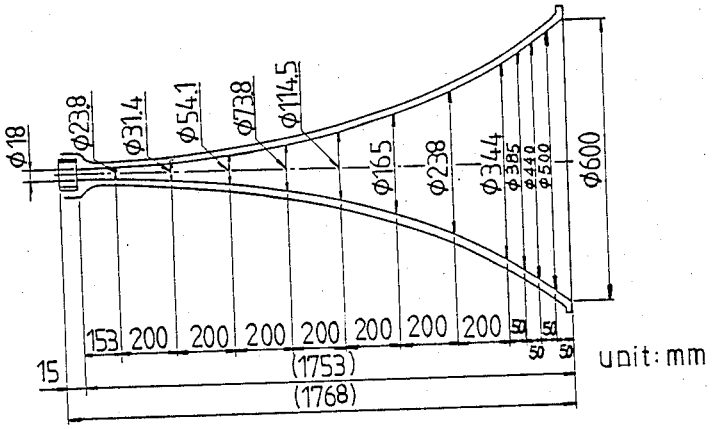
FIG. 2 PRIOR ART
FIG. 2 shows the standard sizes of horns of conventional horn type loudspeakers according to Chinese National Standard of serial No. C6034.

The horn member 4 of the horn type loudspeaker according to the present invention is obviously not restricted by the standard sizes shown in FIG. 2, meaning that sizes and weight of a horn type loudspeaker according to the present invention can be effectively minimized. A horn type loudspeaker of 39 mm (diameter)×25 mm (height) in size and 100 grams in weight for a 100 decibel (dB) can be easily achieved.

Figure 5:
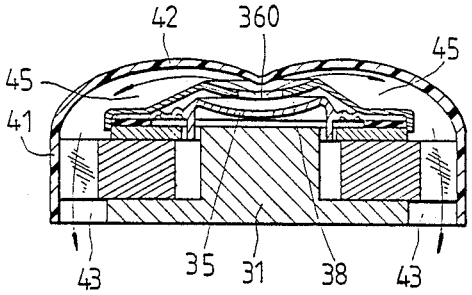
FIG. 5 is a cross-sectional view of a yet another embodiment horn type loudspeaker embodying the present invention.

Alternatively, the reflection cover 42 and the mounting case 41 can be formed integrally and properly enlarged to engage the corresponding pheriphery of an enlarged yoke 31 defining a plurality of discharge openings 43 uniformly located around its outer pheriphery as illustrated in FIG. 5. The sound waves formed by the vibrating air in the air chamber 38 driven by diaphragm 35 radiate through the hole 360, are reflected by the reflection cover 42, continue to radiate along the diffuse passages 45 radially and downwardly, and are eventually discharged through the discharge openings 43.

Figure 4:
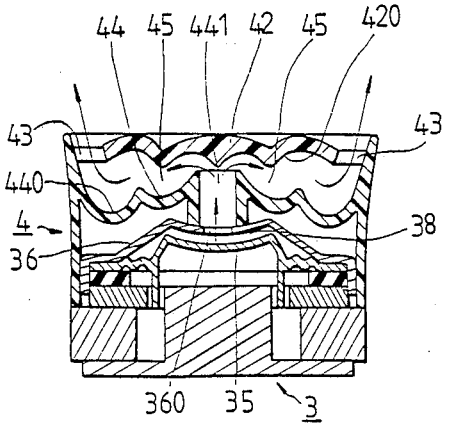
FIG. 4 is a cross-sectional view of another embodiment of a horn type loudspeaker embodying the present invention.

Compared to the embodiments shown in FIGS. 3 and 4, the horn type loudspeaker mentioned above is wider in diameter but shorter in height. A horn type loudspeaker of 44 mm (diameter)×20 mm (height) in size and 100 grams in weight for 100 decibel (dB) can be easily achieved according to this embodiment.

It will be appreciated, of course, that although some particular embodiments of the present invention have been shown and described, modifications may be made. It is intended in the following claims to cover all modifications which fall within the scope of the invention.

What is claimed is:

1. In a loudspeaker having a drive unit including a yoke, a center pole extending from the yoke, a magnet disposed around the center pole so as to define a first air space therebetween, a guide ring disposed around the center pole so as to define a second air space therebetween, a diaphragm extending over and spaced from the center pole and a voice coil attached to the diaphragm and extending into the second air space, the improvements comprising:

(a) a fixing plate extending over, but spaced from the diaphragm such that the diaphragm is located between the fixing plate and the center pole, the fixing plate defining a central hole therethrough; and, (b) a reflection cover extending over, but spaced from the fixing plate, the reflection cover having a curved cross-sectional configuration with a protruding tip located adjacent to the central hole of the fixing plate wherein the reflection cover defines a plurality of discharge openings uniformly located around an outer periphery.

2. The improved loudspeaker according to claim 1 further comprising:

(a) a disk member located between the reflection cover and the fixing plate, the disk member defining a central aperture; and (b) a generally cylindrical throttle member extending from the disk member toward the fixing plate, the throttle member defining a passageway in alignment with the central aperture of the disk member.

3. The improved loudspeaker according to claim 2 wherein the cross-sectional shape of the reflection cover defines a plurality of first cusps and the cross-sectional shape of the disk member defines a plurality of second cusps laterally offset with respect to the plurality of first cusps.

4. The improved loudspeaker according to claim 1 wherein a plurality of discharge openings are defined by the yoke and the magnet.

* * * * *